US005539955A

United States Patent [19]

Wiese

[11] Patent Number: 5,539,955

[45] Date of Patent: Jul. 30, 1996

[54] ADHESIVE MOUNTED PLASTIC HINGES

[75] Inventor: Lee R. Wiese, Upper Nyack, N.Y.

[73] Assignee: Henschel-Steinau, Inc., Englewood, N.J.

[21] Appl. No.: 418,153

[22] Filed: Apr. 6, 1995

Related U.S. Application Data

[63] Continuation of Ser. No. 215,752, Mar. 3, 1994, abandoned.

[51] Int. Cl.[6] ..... E05D 1/00

[52] U.S. Cl. ..... 16/225

[58] Field of Search ..... 16/225, 227, 382, 16/385

[56] References Cited

U.S. PATENT DOCUMENTS

| | | | |
|---|---|---|---|
| 3,222,437 | 12/1965 | Schilling . | |
| 3,320,225 | 5/1967 | Bradbury . | |
| 3,442,415 | 5/1969 | Glass | 16/227 |
| 3,445,052 | 5/1969 | Lewallen . | |
| 3,615,035 | 10/1971 | Newton . | |
| 4,359,506 | 11/1982 | Wiggins et al. . | |
| 4,563,381 | 1/1986 | Woodland | 428/156 |
| 4,617,207 | 10/1986 | Ueki et al. . | |
| 4,651,382 | 3/1987 | Krolick | 16/124 |
| 4,885,820 | 12/1989 | Erceg et al. | 16/225 |
| 5,059,476 | 10/1991 | Steiniger et al. | 428/217 |

FOREIGN PATENT DOCUMENTS

| | | | |
|---|---|---|---|
| 2439807 | 3/1976 | Germany | 16/225 |
| 31657 | 12/1933 | Netherlands . | |

*Primary Examiner*—Maurina T. Rachuba
*Assistant Examiner*—Kenneth J. Hansen
*Attorney, Agent, or Firm*—Samuelson & Jacob

[57] ABSTRACT

A plastic hinge is attached to selected substrates by adhesion between the plastic hinge and the substrates to effect a hinged connection between the substrates and includes a hinge member of a synthetic polymeric material having desired hinge characteristics, a mounting member of a material capable of adhesion to a corresponding selected substrate, and mechanical interlocking elements mechanically securing together the hinge member and a corresponding mounting member such that the plastic hinge is secured to each selected substrate by adhesion between each mounting member and a corresponding selected substrate.

12 Claims, 3 Drawing Sheets

ADHESIVE MOUNTED PLASTIC HINGES

This application is a continuation of application Ser. No. 08/215,752 filed Mar. 3, 1994, now abandoned.

The present invention relates generally to plastic hinges and pertains, more specifically, to plastic hinges capable of being adhered in place upon any one of a variety of substrates.

Plastic hinges have found acceptance as the hinge of choice in a wide variety of applications requiring a relatively light duty, low-cost and unobtrusive hinge. In general, a plastic hinge takes advantage of the flexure characteristics of certain synthetic polymeric materials such as, for example, polypropylene and polyethylene, in the construction of a hinge member which will provide the hinge qualities necessary for joining together various structural members in a hinged connection. However, these synthetic polymeric materials do not lend themselves to adhesive attachment to structural members, thus limiting the availability of plastic hinges in still wider varieties of applications where a plastic hinge otherwise could provide a desirable hinged connection. For example, hinged connections between acrylic or styrene panels are common in boxes, display cases, small cabinets and the like, and the ability to employ a plastic hinge is limited by the inability to adhere the material of the plastic hinge, i.e., polypropylene or polyethylene, directly to the acrylic or styrene panels.

The present invention provides a plastic hinge construction which enables adhesive attachment of the plastic hinge to a variety of structural members for a hinged connection. As such, the present invention attains several objects and advantages, some of which are summarized as follows: Enables a plastic hinge to be employed readily in applications heretofore unavailable to plastic hinges; provides economical alternatives to more expensive hinged connections; simplifies the affixation of plastic hinges in a wide variety of structures; enables the creation of simplified, relatively inexpensive boxes, display cases, small cabinets and the like with hinged panels; makes available a ready supply of plastic hinges of a variety of sizes and configurations without multiplying the inventory of plastic hinges necessary to achieve such a variety; provides plastic hinges for a myriad of uses heretofore not amenable to the use of plastic hinges; enables the ready affixation of plastic hinges to a wider variety of structural members with ease and reliability.

The above objects and advantages, as well as further objects and advantages, are attained by the present invention which may be described briefly as a plastic hinge for attachment to selected substrates by adhesion between the plastic hinge and the substrates to effect a hinged connection between the substrates, the plastic hinge comprising: a hinge member of a synthetic polymeric material having desired hinge characteristics; a mounting member of a material capable of adhesion to a corresponding selected substrate; and mechanical interlocking means mechanically securing together the hinge member and the mounting member such that the plastic hinge can be secured to each selected substrate by adhesion between each mounting member and a corresponding selected substrate.

The invention will be understood more fully, while still further objects and advantages will become apparent, in the following detailed description of preferred embodiments of the invention illustrated in the accompanying drawing, in which.

Figure 1:
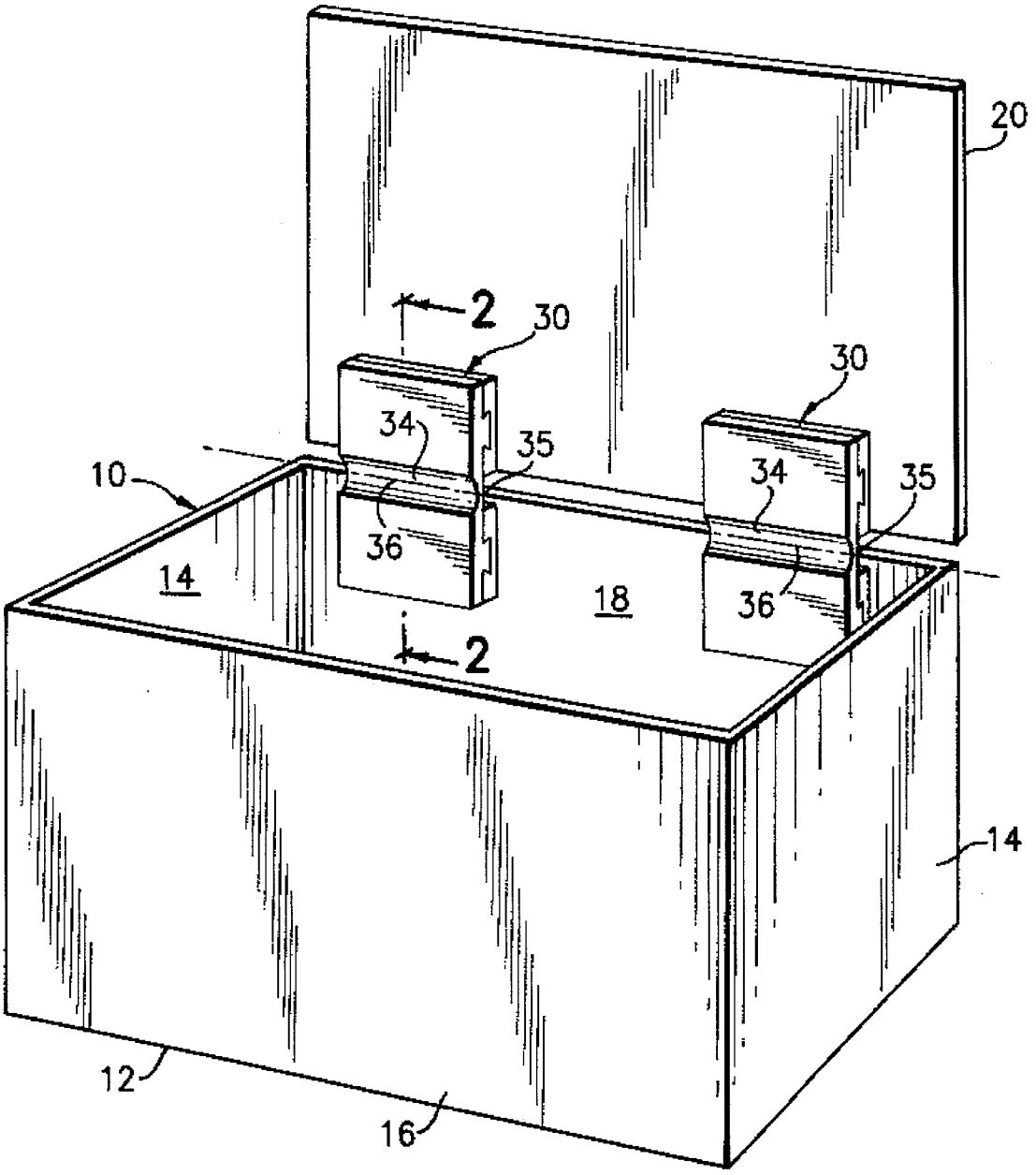
FIG. 1 is a pictorial perspective view of a box employing plastic hinges constructed in accordance with the present invention.

Referring now to the drawing, and especially to FIG. 1 thereof, a box 10 is constructed of a synthetic polymeric material, such as an acrylic or a styrene, and is seen to include a bottom 12, sides 14, a front 16 and a back 18 which, in the illustrated embodiment, are constructed of an acrylic material. A cover 20 is hinged to the back 18 by means of plastic hinges 30 constructed in accordance with the present invention.

Figure 2:
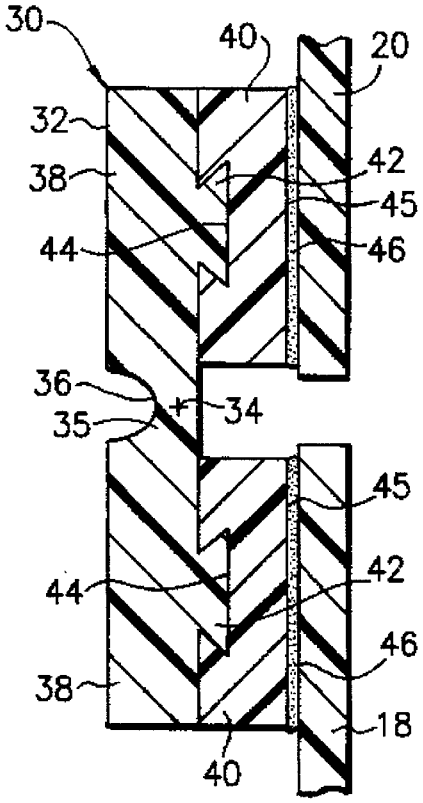
FIG. 2 is an enlarged fragmentary cross-sectional view taken along line 2—2 of FIG. 1.

As best seen in FIG. 2, as well as in FIG. 1, plastic hinges 30 each include a hinge member 32 of a synthetic polymeric material having desirable hinge characteristics, such as polypropylene or polyethylene, the hinge member 32 including a hinge line 34 along which the hinge member 32 flexes by virtue of a relatively thinner cross-section in a web 35 established by a notch 36 extending longitudinally along the hinge member 32, coincident with the hinge line 34 and dividing the hinge member 32 into laterally opposite sides 38. Those synthetic polymeric materials which exhibit the desired hinge characteristics do not lend themselves readily to adhesive attachment to substrates such as the acrylic back 18 and the acrylic cover 20 of box 10. In order to enable such adhesive attachment, plastic hinge 30 is provided with mounting members 40 which are secured to hinge member 32 by mechanical interlocking means, illustrated in the form of interlocking tongue-and-groove elements including a male dove-tail element 42 shown formed unitary with the hinge member 32 within each side 38 and spaced laterally from the notch 36, and a complementary counterpart female dove-tail element 44 shown formed into each mounting member 40.

Mounting members 40 are constructed of a material having adhesion characteristics which enable mounting members 40 to be adhered to the substrates provided by back 18 and cover 20 of box 10. In this instance, mounting members 40 are constructed of a synthetic polymeric material which can be adhered to the acrylic material of back 18 and cover 20, the preferred material of the mounting members 40 being an acrylic so as to provide affixation surfaces 45 which are located opposite the mechanical interlocking means and are adhered readily to back 18 and cover 20 by an adhesive 46. In this manner, each plastic hinge 30 is secured readily to back 18 and to cover 20 to hinge the cover 20 to the back 18 of box 10.

Figure 3:
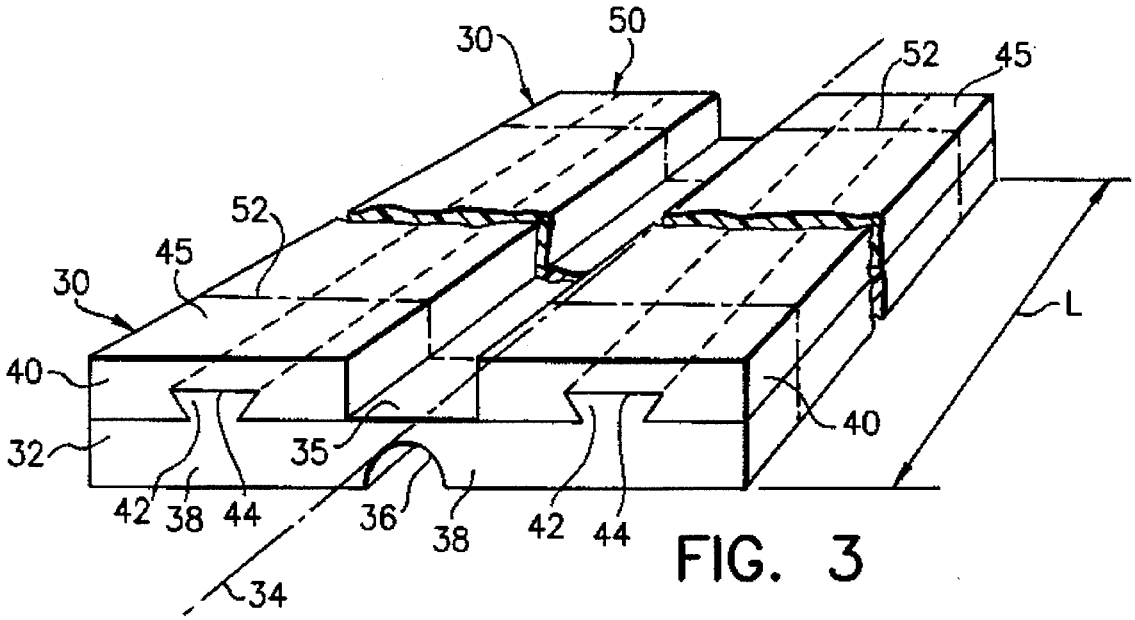
FIG. 3 is a perspective view of a strip of indeterminate length from which the plastic hinges were severed.

In a preferred construction, as illustrated in FIG. 3, a plastic hinge 50 is provided in an indeterminate length L which exceeds the corresponding length of each plastic hinge 30, and plastic hinges 30 are severed from plastic hinge 50 at selected locations, as along cut lines 52, to provide plastic hinges 30 of a selected length. In this manner, plastic hinge 50 can be manufactured economically in long lengths, as by extruding hinge member 32 and mounting members 40 and interengaging the tongue-and-groove elements to secure together the mounting members 40 and the hinge member 32. By supplying a plastic hinge 50 of relatively long length L, a ready supply of plastic hinges 30 is made available in a variety of sizes and configurations without multiplying the inventory of plastic hinges necessary to achieve such a variety.

Figure 4:
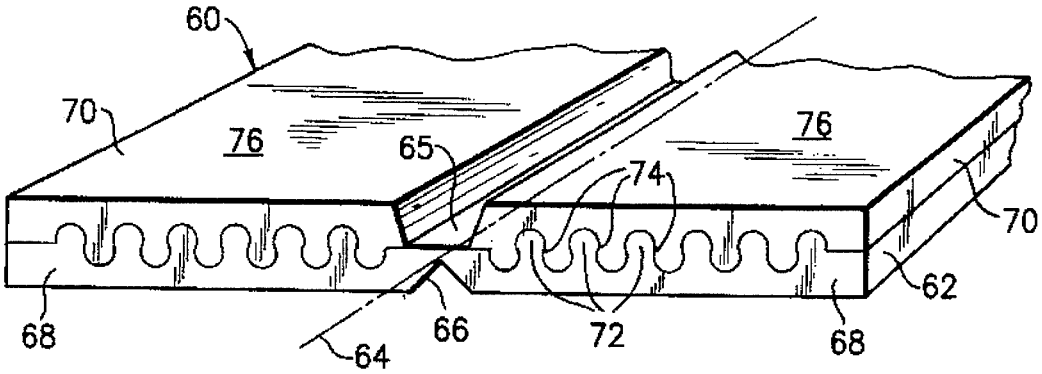
FIG. 4 is a fragmentary perspective view illustrating an alternate construction.
Figure 5:
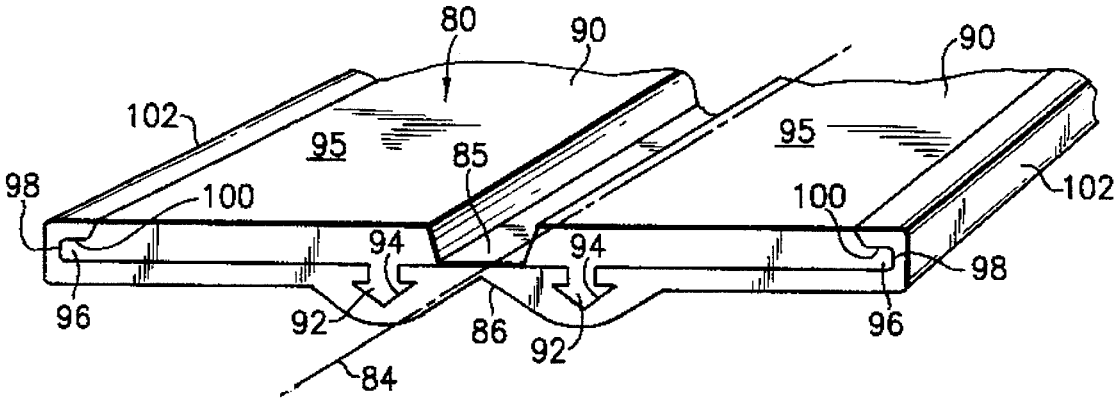
FIG. 5 is a fragmentary perspective view showing another alternate construction.

Various mechanical interlocking means are available for securing together the hinge member and the mounting members. Thus, as illustrated in FIG. 4, a plastic hinge 60 includes a hinge member 62 having a hinge line 64 along which extends a web 65 created by a notch 66 which divides the hinge member 62 into laterally opposite sides 68. Mounting members 70 are secured mechanically to each side 68 of the hinge member 62 by means of interlocking laterally-bulged splines 72 and laterally-undercut grooves 74 formed integral with the hinge member 62 and the mounting members 70 and provide affixation surfaces 76 opposite the splines 72. As seen in FIG. 5, a plastic hinge 80 includes a hinge member 82 having a hinge line 84 along which extends a web 85 created by a notch 86 dividing the hinge member 82 into laterally opposite sides 88. Mounting members 90 are secured mechanically to the hinge member 82 by means of interlocking headed tongues 92 and complementary undercut grooves 94 formed integral with the mounting members 90 and each side 88 of the hinge member 82, respectively, and provide affixation surfaces 95 opposite the headed tongues 92. In addition, each mounting member 90 has a lip 96 extending longitudinally along the outer edge 98 of the mounting member 90, and the lip 96 is received within a complementary channel 100 extending longitudinally along the corresponding outer edge 102 of the hinge member 82 for added integrity in mechanically securing together the hinge member 82 and the mounting members 90.

In all of the embodiments illustrated herein, the mechanical interlocking means include mechanical interlocking elements which extend longitudinally along the plastic hinge parallel to the hinge line of the hinge and which have complementary interlocking lateral cross-sectional configurations capable of being interlocked by relative altitudinal interengagement; that is, by moving one interlocking element in an altitudinal direction relative to the complementary interlocking element to interengage the complementary interlocking elements. Such a preferred construction enables the economical manufacture of the hinge member and the mounting members by extrusion so as to provide a relatively low-cost plastic hinge readily applied to a wide variety of substrates by adhesion. The affixation surfaces are continuous, flat surfaces available for ready adhesion to a selected substrate.

It will be seen that the present invention attains the several objects and advantages summarized above, namely: Enables a plastic hinge to be employed readily in applications heretofore unavailable to plastic hinges; provides economical alternatives to more expensive hinged connections; simplifies the affixation of plastic hinges in a wide variety of structures; enables the creation of simplified, relatively inexpensive boxes, display cases, small cabinets and the like with hinged panels; makes available a ready supply of plastic hinges of a variety of sizes and configurations without multiplying the inventory of plastic hinges necessary to achieve such a variety; provides plastic hinges for a myriad of uses heretofore not amenable to the use of plastic hinges; enables the ready affixation of plastic hinges to a wider variety of structural members with ease and reliability.

It is to be understood that the above detailed description of preferred embodiments of the invention is provided by way of example only. Various details of design and construction may be modified without departing from the true spirit and scope of the invention, as set forth in the appended claims.

The embodiments of the invention in which an exclusive property or privilege is claimed are defined as follows:

1. A plastic hinge for effecting a hinged connection between panels selected from a variety of substrates by adhesive attachment between the plastic hinge and at least one of the panels, the plastic hinge comprising:

a hinge member of a synthetic polymeric material having desired hinge characteristics;

a mounting member separate from the one of the panels and having an affixation surface of a material different from said synthetic polymeric material for enabling adhesive attachment to the one of the panels; and mechanical interlocking means including a first mechanical interlocking element integral with the hinge member and a second mechanical interlocking element integral with the mounting member mechanically securing together the hinge member and the mounting member with the affixation surface exposed for affixation to the one of the panels by adhesive attachment between the affixation surface of the mounting member and the one of the panels.

2. The invention of claim 1 wherein the mechanical interlocking means includes a first mechanical interlocking element integral with the hinge member and a second mechanical interlocking element integral with the mounting member, the first and second mechanical interlocking elements have complementary configurations for interlocking with one another.

3. The invention of claim 1 wherein the mounting member is constructed of a synthetic polymeric material.

4. The invention of claim 3 wherein the mechanical interlocking means includes a first mechanical interlocking element formed unitary with the hinge member and a second mechanical interlocking element formed unitary with the mounting member, the first and second mechanical interlocking elements having complementary configurations for interlocking with one another.

5. A plastic hinge for attachment to selected substrates by adhesion between the plastic hinge and the substrates to effect a hinged connection between the substrates, the plastic hinge comprising:

a hinge member of a first synthetic polymeric material having desired hinge characteristics;

a mounting member constructed of a second synthetic polymeric material and including an affixation surface enabling adhesion to a corresponding selected substrate; and mechanical interlocking means mechanically securing together the hinge member and the mounting member with the affixation surface exposed for affixation to the selected substrate by adhesion between the affixation surface of the mounting member and the corresponding selected substrate;

the mechanical interlocking means including a first mechanical interlocking element formed unitary with the hinge member and a second mechanical interlocking element formed unitary with the mounting member, the first and second mechanical interlocking elements having complementary configurations for interlocking with one another;

the hinge member including laterally opposite sides and a longitudinally extending hinge line between the sides, about which hinge line the hinge member flexes; and the corresponding mechanical interlocking elements extending longitudinally along the hinge member and mounting member;

the mechanical interlocking elements including complementary interlocking lateral cross-sectional configurations for interlocking in altitudinal directions relative to the longitudinal hinge line.

6. The invention of claim 5 including a mounting member secured to the hinge member at each side of the hinge member.

7. The invention of claim 6 wherein the plastic hinge extends longitudinally along an indeterminate length for enabling severing of the indeterminate length at selected locations to establish plastic hinges of selected lengths.

8. A plastic hinge for attachment to selected substrates by adhesion between the plastic hinge and the substrates to effect a hinged connection between the substrates, the plastic hinge comprising:

a hinge member of a synthetic polymeric material having desired hinge characteristics;

a mounting member of a material having an affixation surface different from said synthetic polymer material for enabling adhesion to a corresponding selected substrate; and mechanical interlocking means mechanically securing together the hinge member and the mounting member with the affixation surface exposed for affixation to the selected substrate by adhesion between the affixation surface of the mounting member and the corresponding selected substrate;

the mechanical interlocking means including a first mechanical interlocking element integral with the hinge member and a second mechanical interlocking element integral with the mounting member, the first and second mechanical interlocking elements having complementary configurations for interlocking with one another;

the hinge member including laterally opposite sides and a longitudinally extending hinge line between the sides, about which hinge line the hinge member flexes; and the corresponding mechanical interlocking elements extending longitudinally along the hinge member and mounting member parallel to the hinge line;

the mechanical interlocking elements including complementary interlocking lateral cross-sectional configurations for interlocking in altitudinal directions relative to the longitudinal hinge line.

9. The invention of claim 8 wherein the first mechanical interlocking elements are formed unitary with the hinge member and the second mechanical interlocking elements are formed unitary with the mounting members.

10. The invention of claim 9 including a mounting member secured to the hinge member at each side of the hinge member.

11. The invention of claim 10 wherein the mounting members are constructed of a synthetic polymeric material and include affixation surfaces capable of adhesion to the corresponding selected substrates.

12. The invention of claim 11 wherein the plastic hinge extends longitudinally along an indeterminate length for enabling severing of the indeterminate length at selected locations to establish plastic hinges of selected lengths.

* * * * *